US007225568B1

(12) United States Patent
Rizzo et al.

(10) Patent No.: US 7,225,568 B1
(45) Date of Patent: Jun. 5, 2007

(54) MAGNETIC ADVERTISEMENT

(75) Inventors: Charles J. Rizzo, Reisterstown, MD (US); Richard E. Fearon, Jr., Danbury, CT (US)

(73) Assignee: Magna Card, Inc, Owings Mills, MD (US)

( * ) Notice: Subject to any disclaimer, the term of this patent is extended or adjusted under 35 U.S.C. 154(b) by 135 days.

(21) Appl. No.: 10/713,428

(22) Filed: Nov. 17, 2003

(51) Int. Cl.
*G09F 7/04* (2006.01)

(52) U.S. Cl. ..... 40/600; 40/124.04

(58) Field of Classification Search ..... 40/124.04, 40/600

See application file for complete search history.

(56) References Cited

U.S. PATENT DOCUMENTS

| | | | | |
|---|---|---|---|---|
| 2,967,038 | A | 1/1961 | Lennemann | |
| 3,078,183 | A | 2/1963 | Karalus | |
| 3,093,919 | A | 6/1963 | Holtz | |
| 3,195,022 | A | 7/1965 | Staver | |
| 3,245,737 | A | 4/1966 | Kleinhans | |
| 3,308,989 | A | 3/1967 | Alltop | |
| 3,372,503 | A | 3/1968 | Weeks | |
| 3,532,652 | A | 10/1970 | Zang et al. | |
| 3,710,929 | A | 1/1973 | Morales | |
| 3,713,238 | A | 1/1973 | Hyman et al. | |
| 4,205,500 | A | 6/1980 | Hensley et al. | |
| 4,211,382 | A | 7/1980 | Bonfils | |
| 4,310,978 | A | 1/1982 | Stern | |
| 4,457,425 | A | 7/1984 | Cooper et al. | |
| 4,549,532 | A | 10/1985 | Baermann | |
| 4,605,292 | A | 8/1986 | McIntosh | |
| 4,663,874 | A | 5/1987 | Sano et al. | |
| 4,713,901 | A | 12/1987 | Wells et al. | |
| 4,735,006 | A | 4/1988 | Kane | |
| 4,877,657 | A | 10/1989 | Yaver | |
| 4,957,311 | A * | 9/1990 | Geisenheimer | 283/56 |
| 5,261,174 | A | 11/1993 | Blegen | |
| 5,458,282 | A | 10/1995 | Martin | |
| 5,676,307 | A | 10/1997 | Martin | |
| 5,680,709 | A * | 10/1997 | Stone | 33/613 |
| 5,868,498 | A | 2/1999 | Martin | |
| 5,983,537 | A | 11/1999 | Johnson | |
| 6,024,277 | A | 2/2000 | Martin | |
| 6,035,565 | A * | 3/2000 | Capehart | 40/121 |
| 6,153,279 | A | 11/2000 | Charley | |
| 6,153,280 | A * | 11/2000 | Uffmann | 428/43 |

(Continued)

FOREIGN PATENT DOCUMENTS

| | | |
|---|---|---|
| JP | S62-43481 | 2/1987 |

*Primary Examiner*—Joanne Silbermann
(74) *Attorney, Agent, or Firm*—Andrew Bodendorf

(57) ABSTRACT

According to one implementation a user customizable, magnetic advertisement includes a first magnetic layer having a first surface and a second surface, the first surface including: a first portion and a second portion including printed material. An adhesive may be affixed to the first portion and configured to receive a medium including business information. A protective layer may be affixed to the adhesive and removed to receive the business information medium. The advertisement is customizable by removing the protective layer and affixing the business information medium. In one example, the medium may be a business card and the printed material provided information associated with a business. Additionally the second portion may be a coupon, a frequent purchase coupon, a service reminder, an appointment reminder, or a tag line including information about a business. The second portion also may be configured to receive written indications.

31 Claims, 6 Drawing Sheets

U.S. PATENT DOCUMENTS

| | | | | |
|---|---|---|---|---|
| 6,347,469 | B1 * | 2/2002 | Huellinghoff et al. | 40/600 |
| 6,484,428 | B1 * | 11/2002 | Greenwald et al. | 40/600 |
| 6,508,904 | B1 | 1/2003 | Charley | |
| 2002/0133992 | A1 | 9/2002 | Wu | |
| 2003/0049403 | A1 | 3/2003 | Crum et al. | |
| 2003/0067159 | A1 | 4/2003 | Ritchie et al. | |
| 2003/0071703 | A1 | 4/2003 | Machesky | |
| 2003/0090102 | A1 | 5/2003 | Becker | |
| 2003/0090103 | A1 | 5/2003 | Becker | |

* cited by examiner

MAGNETIC ADVERTISEMENT

TECHNICAL FIELD

This invention relates to advertisements, and more particularly to magnetic advertisements.

BACKGROUND

Advertising is a very important component of most successful businesses. Through advertising a business may reach new and old customers, and retain current customers. One popular method of advertising is the distribution of magnetic advertising that may be placed in conspicuous and convenient locations, such as doors, desks, whiteboards, and appliances. The magnetic advertising helps a business to distinguish itself from competitors by providing important information to a customer about the business in a way that is highly visible and easily accessible. In addition, the magnets provide a utility, such as allowing users to affix papers or pictures to a magnetic receptive surface.

However, one important item associated with any advertising is cost. For some businesses it is important to efficiently manage the cost of advertising. For example, many small businesses or individuals have limited means to expend on advertising. For these businesses, minimizing the cost associated with advertising may be a significant consideration.

Although tradition magnetic advertisements (i.e., ad specialty magnets) are a relatively inexpensive when compared to other forms of advertising, a business must order and wait for production of the ad specialty magnetic with business specific information. In addition, if any information changes once the ad specialty magnets are produced, the advertisements may be rendered obsolete. As a result, the traditional user may order a smaller number of advertisements, and reorder magnets as necessary.

Although this approach may reduce the costs associated with replacing the ad specialty magnets, it does not eliminate the possibility of advertisements with obsolete information and it may result in shortages of magnets (e.g., due to unexpected increases in business activity). Moreover, the cost per unit magnet increases with smaller order sizes since traditional magnetic advertisements require significant setup costs related to printing customized information on the magnets by the ad specialty magnet supplier. These costs are primarily fixed.

Therefore, for the above and other reasons, new methods and forms of magnetic advertisements are needed to supplement traditional magnetic advertisements.

SUMMARY

According to one implementation, a user-customizable, magnetic advertisement may include a first magnetic layer having a first surface and a second surface, the first surface further including: a first portion and a second portion including printed material; an adhesive affixed to the first portion and configured to receive a medium including business information; and a protective layer affixed to the adhesive which may be removed to receive the business information medium. The advertisement is customizable by removing the protective layer and affixing the business information medium.

In one example, the medium may be a business card and the printed material may provide information associated with a business. In one implementation, the dimensions of the first portion of the first surface are substantially two inches by three and one half inches (e.g., the size of a standard business card). Additionally the second portion may be a coupon, a frequent purchase coupon, a service reminder, an appointment reminder, or a tag line including information about a business.

The second portion may be configured to receive written indications. The second portion may include designated areas to receive written information, such as for example an appointment, a date, a time, a service to be performed, a make, a model, and one or more services to be performed on a vehicle.

The second surface of the magnetic layer may be configured for placement on a magnetic receptive material to display the advertisement. The magnetic layer also may be formed in a shape identified with a business.

The first layer may include a boundary between the first portion and the second portion. The boundary may include perforations, indentations, or scoring to aid in the separation of the first portion from the second portion.

In another implementation a user customized magnetic advertisement may include a first magnetic layer having a first surface and a second surface, the first surface further including a first portion and a second portion including printed business material; an adhesive affixed to the first portion; and a medium affixed to the adhesive including information identifying a business.

In another implementation, a method of customizing a magnetic advertisement may include providing a magnetic layer including a first portion with an adhesive and a protective layer covering the adhesive and second portion including printed business material; removing the protective layer to expose the adhesive; affixing a medium having information identifying a business to the adhesive; and distributing the magnetic layer with affixed medium.

Other features and advantages will be apparent from the description, the drawings, and the claims.

DESCRIPTION OF DRAWINGS

Like reference symbols in the various drawings indicate like elements.

DETAILED DESCRIPTION

Figure 1:
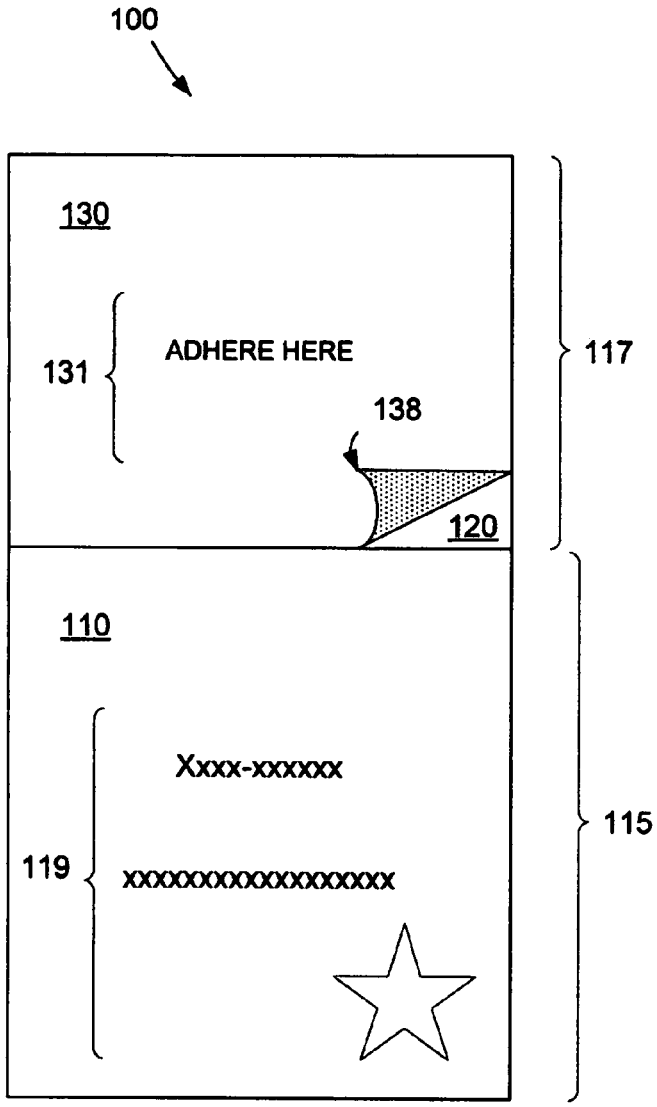
FIG. 1 is an exemplary front view of a magnetic advertisement.
Figure 2:
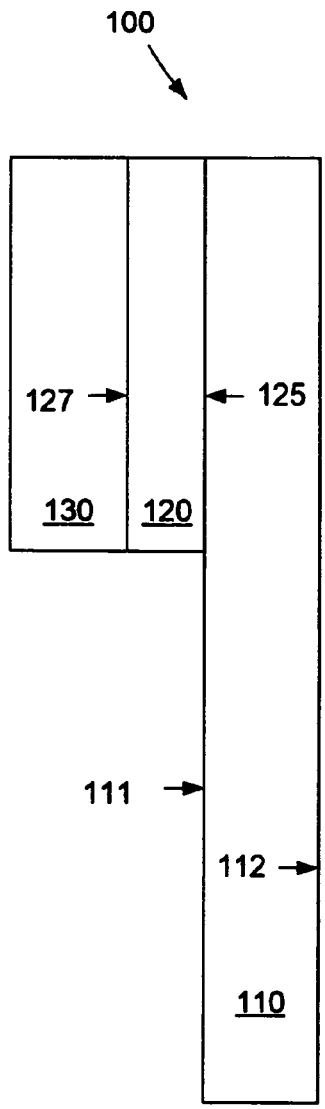
FIG. 2 is an exemplary cross-sectional view of the advertisement of FIG. 1.

FIGS. 1 and 2 show an implementation of a magnetic advertisement 100. The magnetic advertisement 100 includes a layer 110 that may be made using a magnetic material. The layer 110 may be formed as a single layer of a rubber or polymer or as a combination of materials or layers bonded together to form the layer 110. The layer 110 may be magnetized by including a number of ferromagnetic or magnetized particles distributed in the layer 110 causing the layer to exhibit magnetic properties (such as affixing the advertisement 100 to a magnetic receptive surface).

The layer 110 may include a first surface 111 and a second surface 112. The first surface 111 may be divided into two or more portions. As shown in FIGS. 1 and 2, the first surface 111 is divided into two portions 115 and 117. The first portion 115 may include printed material 119. The printed material 119 may include text and/or graphics. For example, the printed material 119 may include one or more of a logo, a symbol, an icon, a design, a picture, an emblem, a line, a pattern, a graphical depiction, and/or an image. The printed material 119 also may include numbers, characters, trademarks, trade names, service marks, and other business information. Further examples of the printed material 119 are described in detail below.

The printed material 119 may be placed on the first surface 111 using a printing process, such as, for example, silkscreening, sheet fed or web offset printing, web letter press printing, gravure printing, and/or inkjet or laser printing.

The first portion 115 also may include areas to receive, writing, characters, symbols, numbers, marks, hole-punches and other indications. The first surface 111 may be made of or coated with a material receptive to marking, such as, for example, polyvinyl, LEXAN, MYLAR, and/or DURALAR.

A second portion 117 of the first surface 111 may be used to customize the advertisement 100. In one implementation, the second portion 117 may include dimensions of at least 2 inches by 3.5 inches (e.g., the size of a standard business card). In one implementation, an adhesive 120 may be applied to the second portion 117 of the first surface 111. The adhesive 120 includes at least a first side 125 and a second side 127. The adhesive 120 may be applied in any manner suitable to bond or affix, temporarily or permanently, a first side 125 of the adhesive 120 to the first surface 111 of the layer 110.

The adhesive 120 may be formed using glue, cement, paste, tackified rubber (e.g., natural rubber, olefin, silicone, polyisoprene, polybutadiene, polyurethane, styrene-isoprene-styrene, styrene-butadiene-styrene block copolymers) and takified or untakified acrylic adhesives such as copolymers of isootylacrylate and acrylic acid (which may be polymerized by radiation, solution, suspension, or emulsion techniques) and polymeric binders. The adhesive 120 may be applied to substantially the entire second portion 117 or to a certain area or areas of the second portion 117.

The second side 127 of the adhesive 120 may be covered by a protective layer 130, such as, for example, release paper. The layer 130 protects the adhesive 120 from contamination or premature bonding. The protective layer 130 may be clear, colored, opaque, and/or transparent and may include printed material 131 (e.g., directions for use). The protective layer 130 may be removed to provide access to the adhesive 120 in order to customize the advertisement 100. For example, a corner 138 of the protective layer 130 may be lifted by a user to peel or remove the protective layer 130 and thereby expose the adhesive 120.

Figure 3:
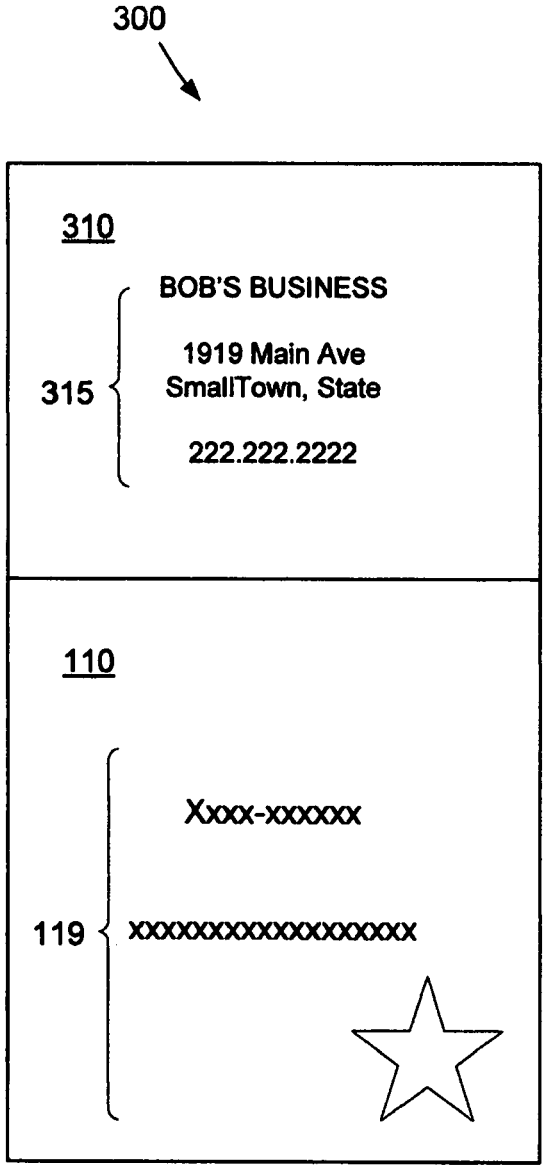
FIG. 3 is an exemplary customized magnetic advertisement.
Figure 4:
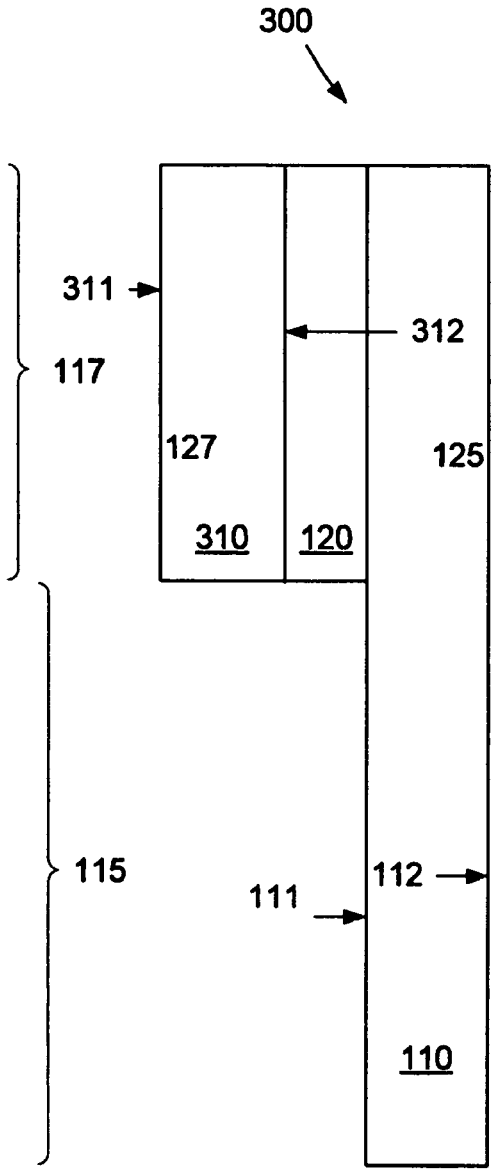
FIG. 4 is an exemplary cross-sectional view of the customized advertisement of FIG. 3.

As shown in FIGS. 3 and 4, the advertisement 100 may be modified to provide a customized advertisement 300 by affixing a medium 310 including printed material 315 to the advertisement 100. The medium 310 may be made from any number of materials or composites (e.g., various paper and/or plastic materials) that adhere to adhesive 120.

The medium 310 may include a first side 311 and a second side 312. The first side 311 may include printed material 315, such as, one or more of a logo, a symbol, an icon, a design, a picture, an emblem, a line, a pattern, a graphical depiction, and/or an image. The printed material 315 also may include numbers, characters, trademarks, trade names, and/or service marks. The printed material may include names, phone numbers, fax numbers, addresses, email and web site information. Further examples of the printed material 315 are described in further detail below. In one example, the medium 310 and printed material 315 may constitute a business card.

To customize the advertisement 100, a user may remove the protective layer 130 to provide access to the adhesive 120. After removing layer 130, the user may place the second side 312 of the medium 310 in contact with the second side 127 of the adhesive 120 to temporarily or permanently affix or bond the medium 310 and printed material 315 to the adhesive 120. Once affixed, the printed material 119 and 315 may be displayed by placing the second surface 112 of layer 110 in contact with a surface receptive to magnets (e.g., a surface containing iron).

Figure 5:
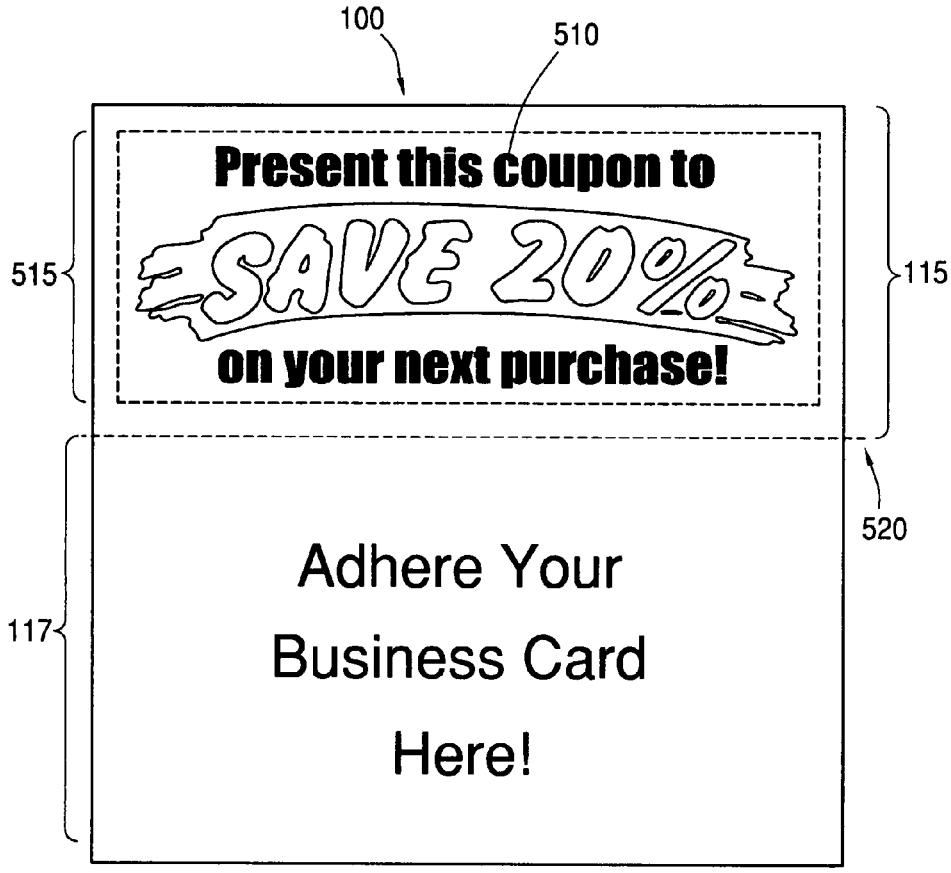
FIG. 5 is an exemplary magnetic advertisement including a coupon.

As shown in FIG. 5 an advertisement 100 may include printed material in the first portion 115, such as a coupon 510. In this implementation, a user may order the advertisement 100 to include printed material 515 on the first portion 115 that indicates information commonly found in coupons, such as, for example, discounts, money-back, free products/services, terms and/or dates/times (e.g., when redeemable or an expiration). In another implementation, the coupon 510 may be a frequent purchase or customer coupon. The frequent purchase coupon may be marked to indicate purchases by affixing indications to the coupon, marking the coupon, or removing portions of the coupon (e.g., with a hole punch).

The coupon 510 may be removed or detached from the advertisement 100. For example, the coupon 510 may be torn or cut along a boundary 520. In one implementation, the boundary 520 may include perforations, indentations, or scoring (of the first and/or second surface) to aid in removal of the coupon 510.

The second portion 117 may include a transparent protective layer 130 under or on which instructions are printed (e.g., "Adhere your business card here"). The user may remove the protective layer 130 and apply a medium 310 to personalize or customize the advertisement. The medium 310 may include information identifying a business and/or an individual, such as, one or more of a name, an address, contact information (e.g., an email, a phone number, a fax number, and a website), a logo, an emblem, a symbol, a graphic, a service mark, a trademark, and a trade name. In one implementation the medium is a business card (e.g., printed on a paper or plastic material).

The coupon 510 may be redeemed by the customer according to the terms of the coupon 515. Since the coupon 510 is magnetized, it improves the chances that the coupon will not be lost by the customer once applied to a surface, such as, for example, an appliance (e.g., refrigerator, microwave, dishwasher, washing machine, furnace) office furniture (e.g., a file cabinet) or a door. In addition, the visibility/accessibility of the coupon is increased, resulting in a higher probability of use by the customer (and thereby increasing business).

Figure 6:
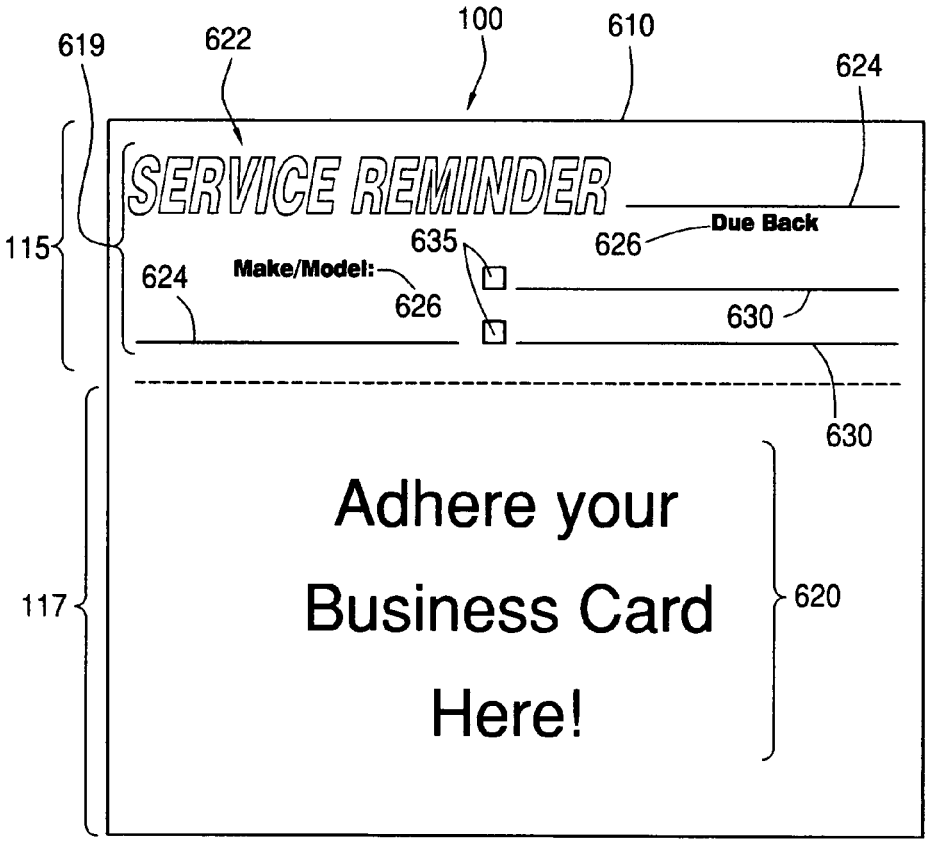
FIG. 6 is an exemplary magnetic advertisement with service reminder/appointment information.

FIG. 6 shows one implementation of an advertisement 100 including printed material for a service reminder 610. In this implementation, a user may order the advertisement 100 to include printed material 619 on the first portion 115 that indicates information commonly used by services and/or professionals to provide information to the customer, such as, reminders for appointments or required services. The first portion 115 also may include areas where additional marks and/or printed information may be indicated. For example, a professional may write in a date and time for an appointment (e.g., a doctor/dentist appoint).

The second portion 117 may include a transparent protective layer 130 under or on which instructions are printed (e.g., "Adhere your business card here"). The user may remove the protective layer 130 and apply a medium 310 to personalize or customize the advertisement 100. The medium 310 may include information identifying a business and/or an individual, such as, one or more of a name, an address, contact information (e.g., an email, a phone number, a fax number, and a web site), a logo, an emblem, a symbol, a graphic, a service mark, a trademark, and a trade name. In one implementation the medium is a business card (e.g., printed on a paper or plastic material).

As shown in FIG. 6, the first portion 115 may include a title line 622 (e.g., "SERVICE REMINDER"). Several areas denoted by lines 624 may be provided for customizing by a user, which may be identified by labels, text, or instructions 626 (e.g., "due back" and "Make/Model"). Additional unmarked areas may be provided by additional lines 630 and check boxes 635. In one example, the service reminder 610 may be used by the auto industry to identify the next service date for a vehicle. The service provider may customize the reminder by writing in the appropriate areas a service due date, information identifying a vehicle, and the services to be performed. Since the service reminder 610 is magnetized, the chance that the reminder will be lost by the customer is reduced. In addition, the visibility/accessibility of the reminder is increased, resulting in a higher probability the customer/client will make an appointment or obtain recommended services (and thereby increase business).

Figure 7:
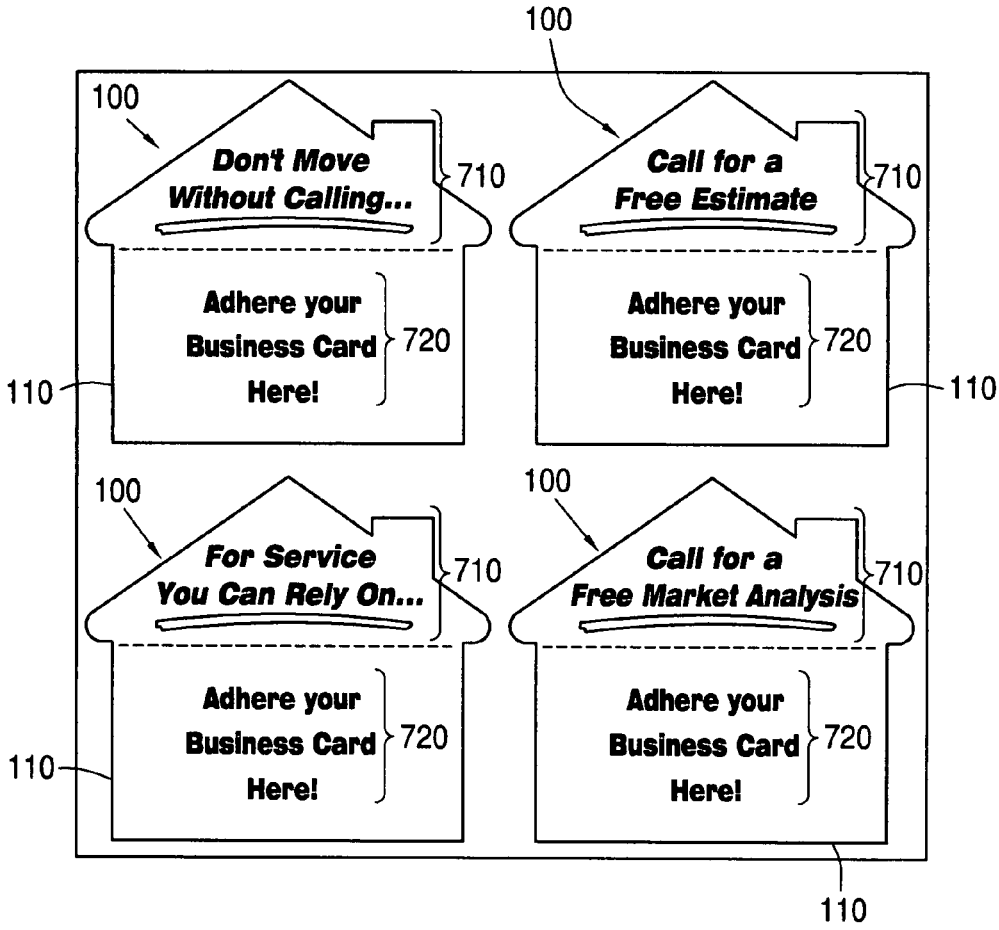
FIG. 7 is an exemplary magnetic advertisement with unique shape and tag line.

FIG. 7 shows several implementations of an advertisement 100. The advertisement 100 may be created in a unique shape that may identify with a customer. For example, as shown in FIG. 7, the layer 110 may be formed in the shape of a house to identify services and/or products associated with a home (e.g., real estate, insurance, and home repair/improvement services). Other examples of shapes include a car (e.g., for automotive industry), a truck, a plane, a computer, a camera, musical instrument, an animal, a trademark, service mark, or tradename, or any other shape which a consumer may use to identify or associate with product, service, or business. In addition the first portion 710 may include information, such as, for example, a tag line and/or a graphic (e.g., "Don't move with out calling," "Call for a free estimate," "For service you can rely on," "Call for a Free market analysis").

The second portion 117 may include a transparent protective layer 130 under or on which instructions are printed (e.g., "Adhere your business card here"). The user may remove the protective layer 130 and apply a medium 310 to personalize or customize the advertisement 100. The medium 310 may include information identifying a business and/or an individual, such as, one or more of a name, an address, contact information (e.g., an email, a phone number, a fax number, and a web site), a logo, an emblem, a symbol, a graphic, a service mark, a trademark, and a trade name. In one implementation the medium 310 is a business card (e.g., printed on a paper or a plastic material).

Figure 8:
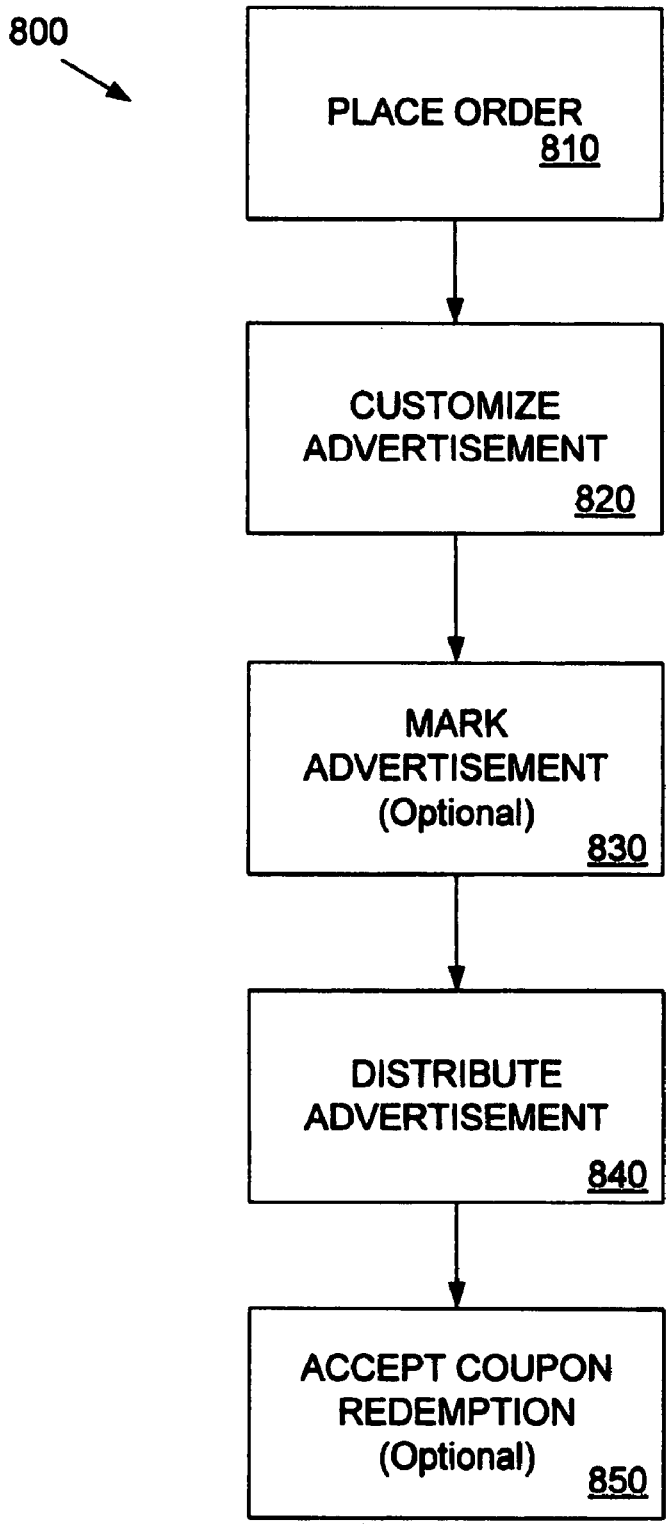
FIG. 8 is an exemplary method for use of magnetic advertisements.

FIG. 8 shows a method of using an advertisement (800). A user may place an order for the magnetic advertisement or purchase the advertisement (810). Upon receipt or upon use, the user may customize the magnetic advertisement by affixing or securing a medium (e.g., a business card) identifying the user and/or a business (820). For example, the user may remove the release sheet and press a business card in the appropriate portion (e.g., the second portion 117 of layer 110). The user also may customize the advertisement by marking the advertisement (830) (e.g., writing appointment information; checking/circle a box or information, adding customer specific information, removing a portion, such as a hole punch). The user may then distribute the advertisement to the customer (840). The customer may place the advertisement in a conspicuous and/or convenient spot to which the advertisement is magnetically attracted. The customer views the advertisement as needed. In addition, the customer may remove and present a portion (e.g., a coupon) of the advertisement or present the entire advertisement to the user or business as needed (850).

According to the implementations described above and shown in the drawings, and modifications and variations thereof, the present application provides a means and methods to customize magnetic advertisements. As described above, businesses and individuals may customize magnetic advertisements by affixing their current and correct business information to the magnets using, for example, a business card. This helps to minimize costs associated with business magnets because the magnets are not rendered obsolete before distribution when business information changes. As a result, individuals and business do not waste the magnetic advertisements and thereby reduce costs associated with the advertising. Furthermore, individuals and businesses may keep larger inventories on hand and avoid shortages. In addition, because the business information and printed material are magnetic, once used by the customer, the information is more readily accessible and visible, less likely to be lost or forgotten, and, therefore, are more likely to be used (thereby increasing business). Finally, the magnetic advertisements are easy to use and require no special training or equipment by the user to make them, and may be customized anywhere.

A number of exemplary implementations have been described. Nevertheless, it will be understood that various modifications may be made. For example, advantageous results still could be achieved if the steps of the disclosed techniques were performed in a different order and/or if elements or components in a disclosed architecture, form, article, or device were combined in a different manner and/or replaced or supplemented by other elements or components. For example, additional portions could be added to the layer 110; so that coupons, tag lines, and service reminders could be included on the same advertisement; or so that multiple coupons, tag line and service reminders are included; or the placement of the portions may be varied. Accordingly, other implementations are within the scope of the following claims.

What is claimed is:

1. A user customizable, magnetic advertisement for a business comprising:

a first magnetic layer having a first surface and a second surface wherein the first surface is divided into a first portion having a first dimension and a second dimension, the first and second dimensions generally forming a two dimensional rectangular shape substantially the size of a business card;

a second portion including information related to the business;

an adhesive affixed to the first portion having first and second dimensions substantially similar to the first portion and configured to receive the business card; and a protective layer affixed to the adhesive which may be removed to receive the business card, wherein the advertisement is customizable by removing the protective layer and affixing the business card.

2. The magnetic advertisement of claim 1 wherein the second portion has a substantially triangular shape having a base abutting the first portion.

3. The magnetic advertisement of claim 2 wherein the dimension of the base is greater than the first dimension of the first portion.

4. The magnetic advertisement of claim 1 wherein the second portion is a coupon.

5. The magnetic advertisement of claim 1 wherein the first layer includes a boundary between the first portion and the second portion, the boundary included one of perforations, indentations, or scoring to aid in the separation of the first portion from the second portion.

6. The magnetic advertisement of claim 1 wherein the second portion has a first dimension that is substantially similar to the first dimension of the first portion, such that when the business card is affixed to the first portion the overall magnetic advertisement presented by the first and second portions has a professional, finished appearance.

7. The magnetic advertisement of claim 1 wherein the second portion includes a service reminder.

8. The magnetic advertisement of claim 1 wherein the second portion includes an appointment reminder.

9. The magnetic advertisement of claim 1 wherein the second portion includes a tag line including information about a business.

10. The magnetic advertisement of claim 1 wherein the second portion is configured to receive written indications.

11. The magnetic advertisement of claim 1 wherein the second portion further comprises designated areas to receive written information.

12. The magnetic advertisement of claim 11 wherein the written information includes one of an appointment, a date and a time.

13. The magnetic advertisement of claim 11 wherein the written information includes a service to be performed.

14. The magnetic advertisement of claim 11 wherein the written information includes one of a make, a model, and one or more services to be performed on a vehicle.

15. The magnetic advertisement of claim 1 wherein the second surface is configured for placement on a magnetic receptive material to display the advertisement.

16. The magnetic advertisement of claim 1 wherein the first and second dimensions of the first portion of the first surface are substantially three and a half inches by two inches.

17. A user customized magnetic advertisement for a business comprising:

a first magnetic layer having a first surface and a second surface, the first surface further comprising:

a first portion having a first dimension and a second dimension the first and second dimensions generally forming a two dimensional rectangular shape substantially the size of a business card;

an adhesive affixed to the first portion, and configured to receive and affix the business card to the adhesive a second portion having a first dimension that is substantially similar to the first dimension of the first portion and including information related to the business, such that when the business card is affixed to the first portion, the customized magnetic advertisement presented by the first and second portions has a professional, finished appearance.

18. The magnetic advertisement of claim 17 wherein the adhesive has first and second dimensions substantially similar to the first portion.

19. The magnetic advertisement of claim 17 wherein the second portion is a coupon.

20. The magnetic advertisement of claim 17 wherein the first layer includes a boundary between the first portion and the second portion, the boundary included one of perforations, indentations, or scoring to aid in the separation of the first portion from the second portion.

21. The magnetic advertisement of claim 17 wherein the second portion includes a frequent purchase coupon.

22. The magnetic advertisement of claim 17 wherein the second portion includes a service reminder.

23. The magnetic advertisement of claim 17 wherein the second portion includes an appointment reminder.

24. The magnetic advertisement of claim 17 wherein the second portion includes a tag line including information about the business.

25. The magnetic advertisement of claim 17 wherein the second portion is configured to receive written indications.

26. The magnetic advertisement of claim 17 wherein the second portion further comprises designated areas to receive written information.

27. The magnetic advertisement of claim 26 wherein the written information includes one of an appointment, a date and a time.

28. The magnetic advertisement of claim 26 wherein the written information includes a service to be performed.

29. The magnetic advertisement of claim 26 wherein the written information includes one of a make, a model, and one or more services to be performed on a vehicle.

30. The magnetic advertisement of claim 17 wherein the second surface is configured for placement on a magnetic receptive material to display the advertisement.

31. The magnetic advertisement of claim 17 wherein the first and second dimensions of the first portion of the first surface are substantially three and a half inches by two inches.

* * * * *